US006042515A

United States Patent [19]

Wang

[11] Patent Number: 6,042,515

[45] Date of Patent: Mar. 28, 2000

[54] JOGGING MACHINE'S PUSHING CASTERS

[76] Inventor: Leao Wang, No.1, Lane 154, Charng Long Rd., Taiping, Taichung, Taiwan

[21] Appl. No.: 09/124,860

[22] Filed: Jul. 30, 1998

[51] Int. Cl.[7] ..... A63B 21/00

[52] U.S. Cl. ..... 482/54; 482/51

[58] Field of Search ..... 482/51, 54

[56] References Cited

U.S. PATENT DOCUMENTS

| | | | |
|---|---|---|---|
| 5,676,624 | 10/1997 | Waterson et al. | 482/54 |
| 5,855,537 | 1/1999 | Coody et al. | 482/54 |
| 5,899,834 | 5/1999 | Dalebout et al. | 482/54 |

*Primary Examiner*—Glenn E. Richmon

[57] ABSTRACT

This invention is relating to an improvement configured to a pushing caster of jogging machine. The body of jogging machine contains one master frame, one framework, one jogging board, one front transverse-rod, one hand holder, one rear floor-rod, etc. components. The transverse rod designed for master frame's base and front transverse-rod are fitted to the base of master frame where caster assemblies are plugged and retained at their both ends respectively. Diameter of caster is slightly bigger than diameter of rods. The inner sides of caster assembly, that is, the opposite direction that caster assembly face one another as they are installed at transverse-rod of master frame's base and front transverse-rod, is erected a positioning bushing to secure itself individually. Afterward, the outer circumference of each positioning bushing is enveloped by a floor-type rubber block which is in rectangular shape. This floor-type rubber block can be revolved around positioning bushing. Floor-type rubber block has been featured unequal thickness. It is designed to have its thickness bigger than diameter of caster assembly. Therefore, when the non-slip surface, that is, floor-type rubber block's bottom, contacts with floor surface, it will prop up the height of transverse-rod at master frame's base and the height of front transverse-rod because of the design feature. This prop will create a gap between each caster assembly and floor surface, and then disable caster's flnction. On the other hand, when floor-type rubber block is revolved to lose the contact between non-slip surface and floor surface, the thickness is small enough to reduce the height of transverse-rod at master frame's base and the height of front transverse-rod. The contact mechanism will be switched to caster assembly and floor surface instead. The machine body of jogging machine is ready for pushing movement.

7 Claims, 5 Drawing Sheets

JOGGING MACHINE'S PUSHING CASTERS

BACKGROUND OF THE INVENTION

1. Field of the invention

This invention is relating to the structure of pushing casters equipped to jogging machine. For better understanding, this newly invented and specially erected structure configuration can let jogging machine's body be pushed to slide directly after pack and fold the jogging board and framework vertically.

2. Description of the Prior Art

The so-called jogging machine is a track type equipment suitable for indoor sport. Its typical assembly is to have one front floor-type upright rod and one rear floor-type upright rod installed at front-end base and rear-end base of the jogging machine's framework respectively. They can set the jogging board slightly slant and stick to ground (standby position before usage) when the framework is formally placed. At this moment, user can run on the jogging track to enjoy the jogging exercise. When storage or transportation of machine by folding it is desired, user can lift the jogging board to form a vertical status and lessen its space occupation largely. Thus, take the precedent of consuetudiary patent U.S. Pat. No. 5,676,624 for example, (as shown on FIG. 1), the. jogging board 12 is lifted in vertical status that its front floor rod 14 become the supporting point and bear the whole weight of machine body. Meanwhile, there are caster assemblies 16 equipped to one suitable side of front floor-rod 14 and installed at both ends respectively. When pushing machine body 10 to move its position is desired, this can be done just simply slant machine body 10 in a proper angle, and then caster assembly 16 will touch floor 18 and perform its work (as shown by dash line on the figure). Smoothly pushing machine body 10 to move is now accessible.

Although the structure design of caster assembly 16 described in the precedent of consuetudiary patent can accomplish indeed the expected effects, however, we still can see further findings if we conduct a closer observation. The integral weight that machine body 10 bears is not a light weight. Also, when it is slanted for pushing movement purpose, the front floor-rod 14 has completely departed from floor 18 that let caster assembly 16 become the only one supporting point. Under this circumstance, machine body 10 may fall down to hit the ground 18 because of user ignorance or obstacles on the ground while user is pushing to move machine body 10 without paying special attention to surrounding environment. Certainly it will seriously damage the machine body 10. Furthermore, user may be hurt by the falling machine body 10.

SUMMARY OF THE INVENTION

After put aforementioned consideration into account, the inventor has enthusiastically devoted himself to R&D in this regard. He had been aided by his long-term practical experience to create this invention in the long run. This invention is to provide a caster assembly that can access a freely pushing movement of machine body without slanting it when jogging machine's body is folded in vertical status. It can assure of that no falling and casualty incident will happen. It can further assure the safety while being pushed to move or slide. This is the main objective of this invention.

BRIEF DESCRIPTION OF THE DRAWINGS

For the purpose of better understanding the technical approach and its associated structural characteristics, a series of figures is attached. A brief description of the drawings is listed below.

DETAILED DESCRIPTION OF THE INVENTION

Figure 1:
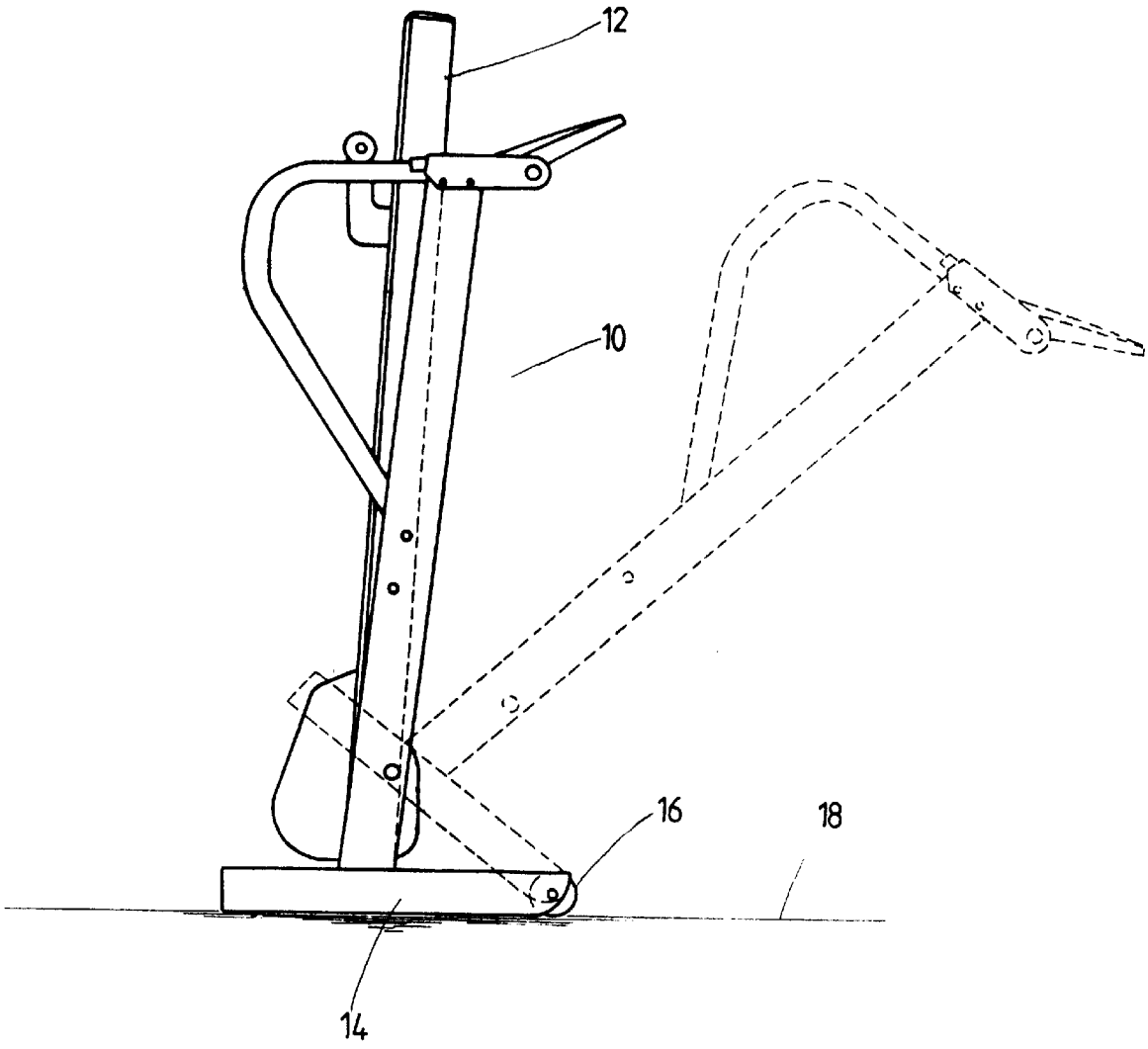
FIG.1 PRIOR ART
FIG. 1: Schematic drawing of the structure and its usage applied to the precedent of consuetudiary patent U.S. Pat. No. 5, 676, 624.
Figure 2:
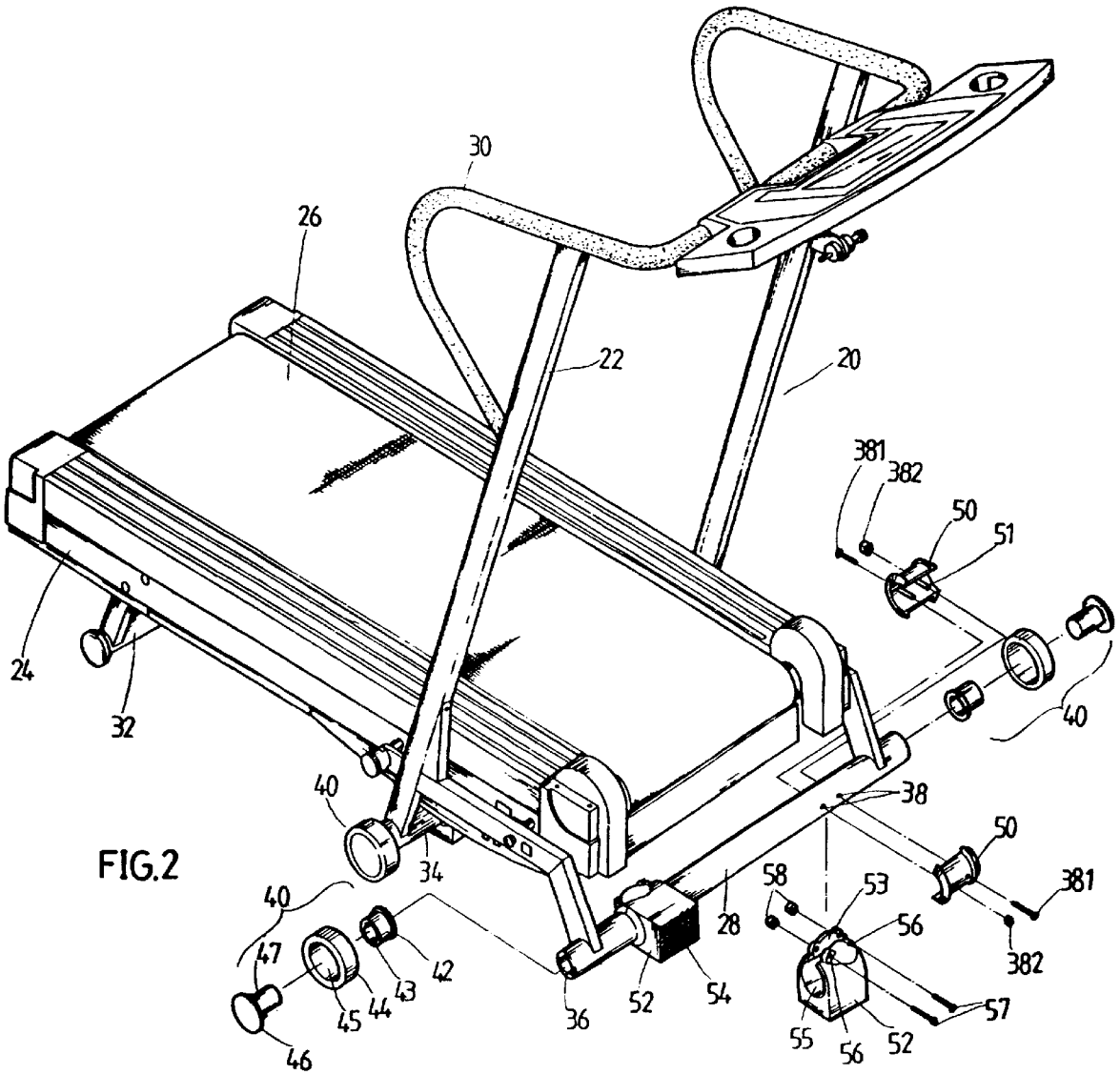
FIG. 2: 3-D Schematic drawing to show the disassembly of this invention.
Figure 3:
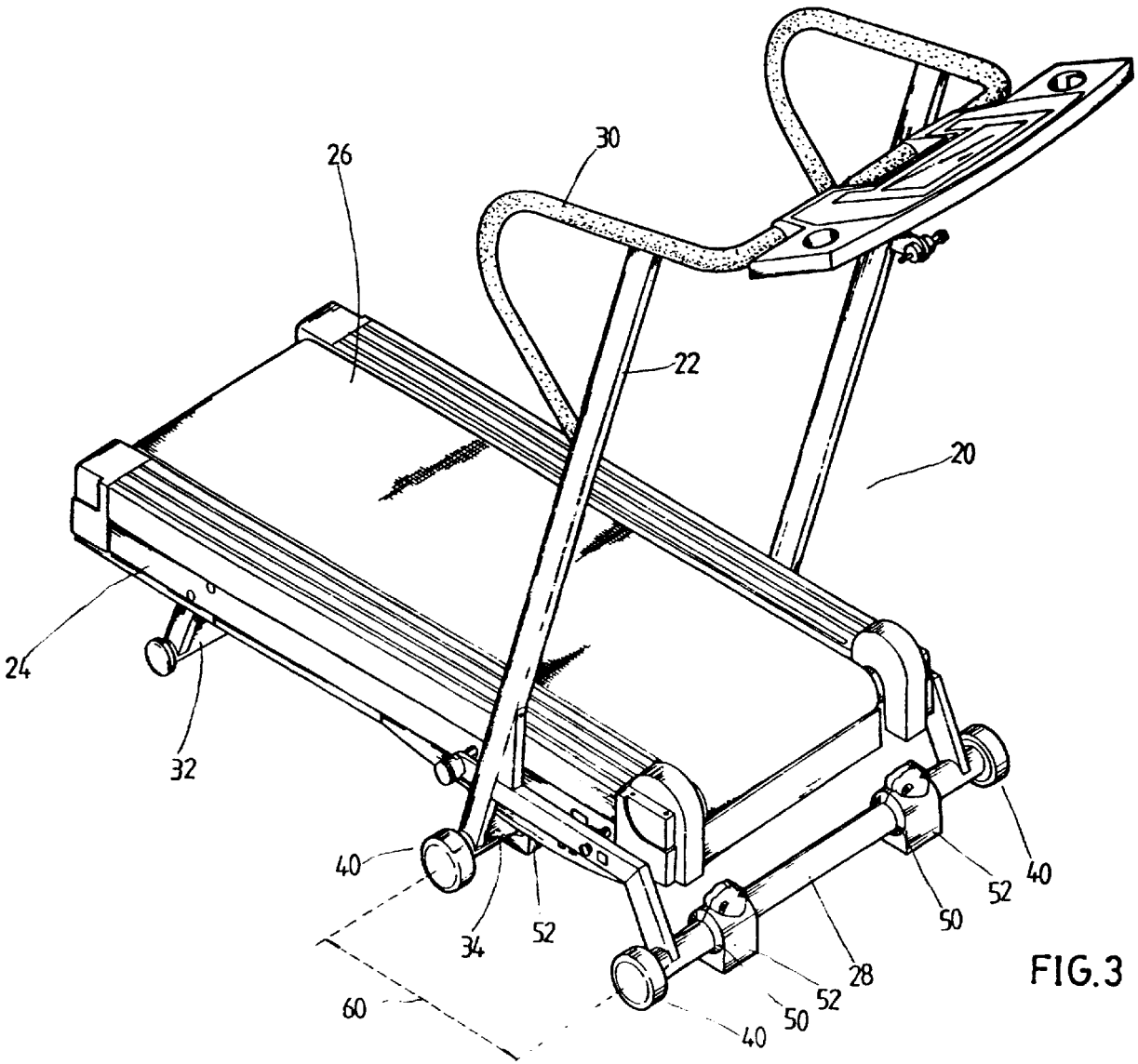
FIG. 3: 3-D Schematic drawing to show the assembly of this invention
Figure 4:
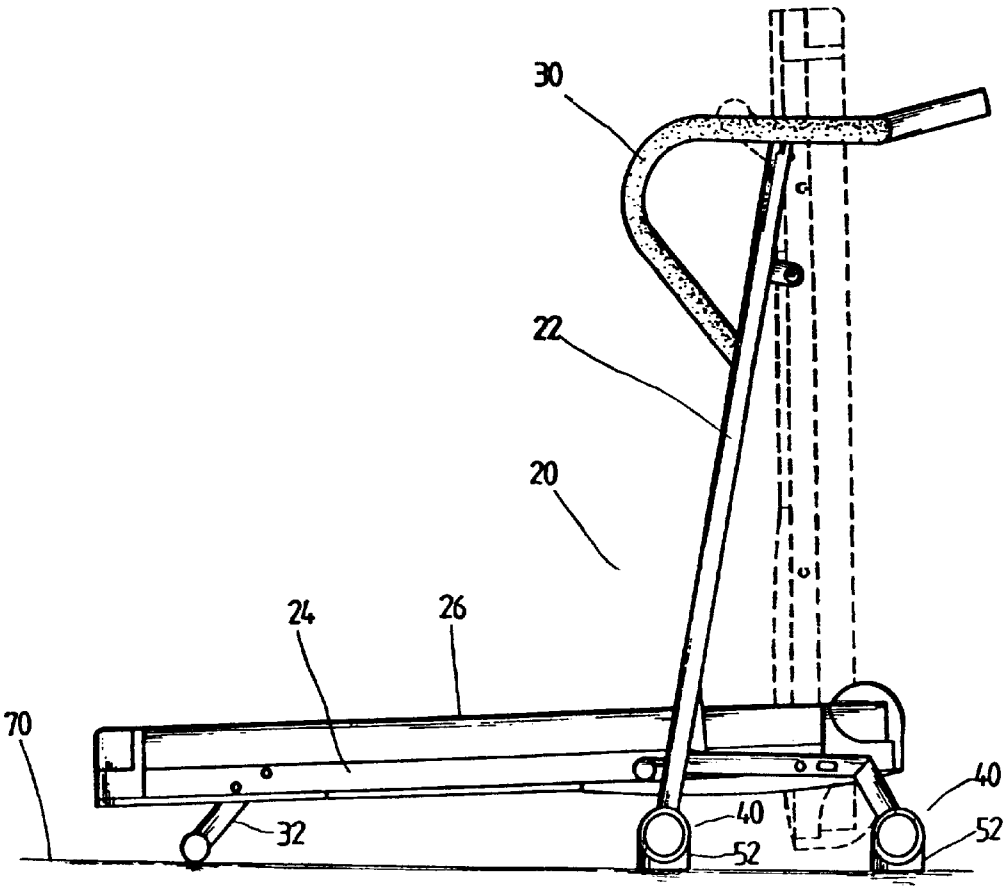
FIG. 4: Side view drawing to show the disassembly of this invention

First of all, please refer to FIG. 2, FIG. 3, and FIG. 4. The body of jogging machine 20 contains one master frame 22, one framework 24, one jogging board 26, one front transverse-rod 28, one hand holder 30 and one rear floor-rod 32, etc. components. The transverse-rod 34 is installed transversely at base of master frame 22 and is parallel to front transverse-rod 28. A supporting frame assembly 60 is formed by both of them. It can effectively and steadily support the body 20 of jogging machine while the jogging board 20 plus framework 24 are lifted and folded in vertical status. Certainly, this supporting frame assembly 60 can work together with rear floor-rod 32 to effectively support machine body 20 after jogging board 26 and framework 24 is horizontally placed to their usage position. Then, user can stand on jogging board and start his jogging exercise.

Figure 6:
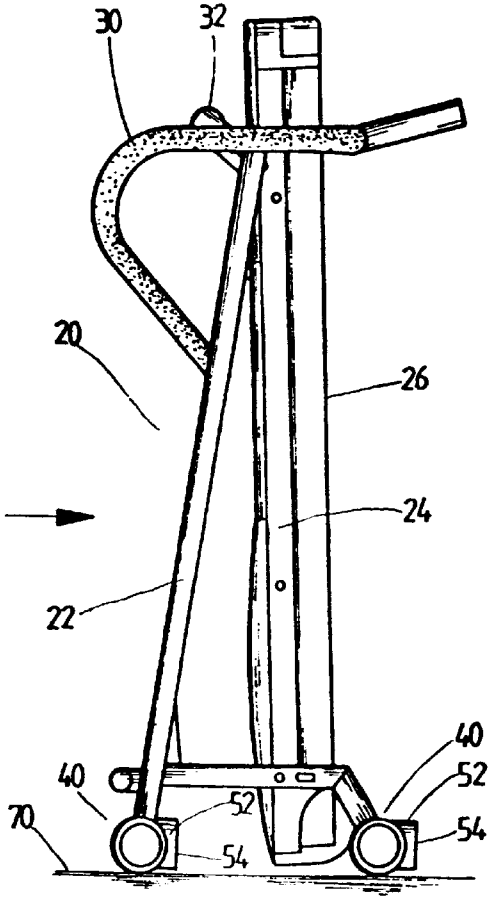
FIG. 6: Side view and schematic drawing to show the existing status ready for immediate pushing movement.
Figure 5:
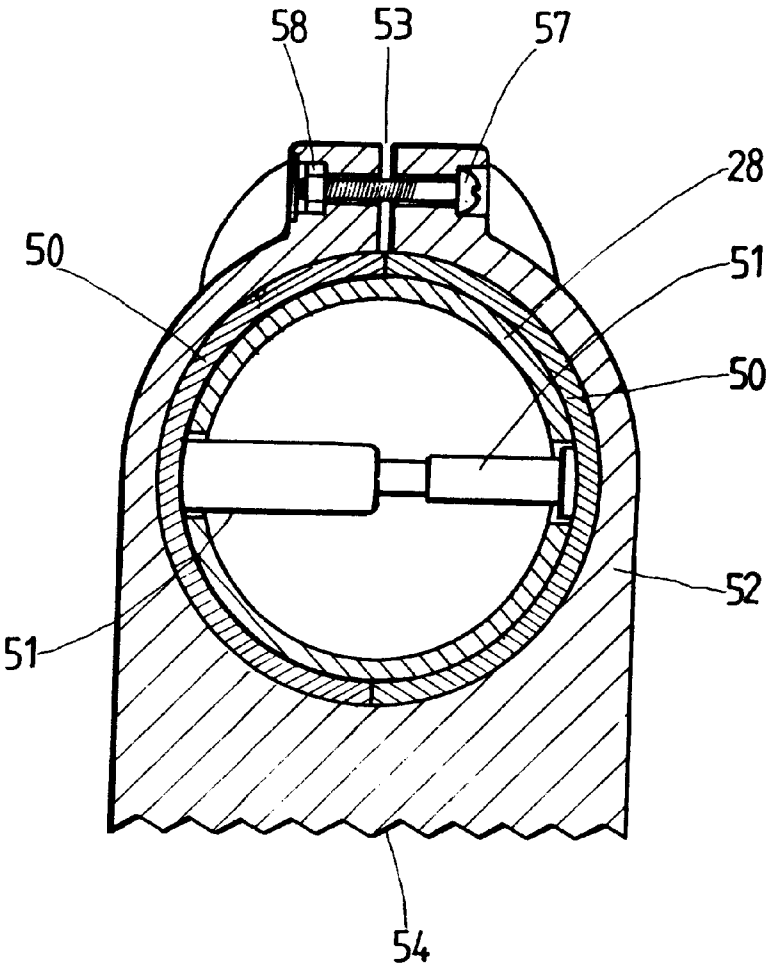
FIG. 5: The schematic and sectional drawing to show the positioning bushing and floor-type rubber block after the completion of assembly.

Afterward, please refer to FIG. 2, FIG. 5 and FIG. 6. Transverse-rod 34 at master frame's base and front transverse-rod 28 are fitted to master frame 22 where caster assembly 40 is plugged and retained at their both ends respectively. Caster's diameter is slightly bigger than rod's diameter. Then, the inner sides of caster assembly 40, that is, the opposite direction that caster assembly face one another as they are installed at transverse-rod 34 of master frame's base and front transverse-rod 28, is erected by a floor-type rubber block 52 that is formed in rectangular shape. This floor-type rubber block 52 can be revolved around positioning bushing 50. Floor-type rubber block 52 has been featured unequal thickness. It is designed to have its thickness bigger than the diameter of caster assembly 40. Therefore, when the non-slip surface 54, that is, floor-type rubber block's 52 bottom, contacts with floor surface 70; it will prop up the height of transverse rod 34 of master frame base and the height of front transverserod 28 because of the design feature. This prop will create a gap between each caster assembly 40 and floor surface 70, and then disable caster's functions. On the other hand, when floor-type rubber block 52 is revolved to lose the contact between nonslip surface 54 and floor surface 70, the thickness is small enough to reduce the height of transverse-rod 34 of master frame's base and the height of front transverse-rod 28. The contact mechanism will be switched to caster assembly 40 and floor surface 70 instead. Then the machine body 20 of jogging machine is ready for pushing movement.

Besides, the caster assembly 40 shown on FIG. 2 and FIG. 5, are composed of one caster kit 42, one caster 44 and one pipe plug 46, etc. The sequence of assembly is firstly to let caster 44 envelop the outer circumference of caster kit 42 through its inner hole 45, and then insert the pipe plug 46 from the opposite side of caster 44. At this moment, the axle pipe 47 of pipe plug will penetrate the inner hole 43 of caster kit 42 and stretch a certain length. Afterward, firmly plug it into the pipe hole 36 located on the transverse-rod 34 of master frame's base and front transverse-rod 28 to retain its position. Thus, caster 44 is now being positioned in between pipe plug 46 and caster kit 42. It's now at a state available to access pivot revolution. The positioning bushing 50 is composed of two semicircular parts as its right part and left part. Their correspondent inner surfaces are fitted with thread hole column 51. It can be threaded into two piercing holes 38 drilled on the correspondent position of transverse-rod 34 of master frame's base and front transverse-rod 28. They can be screwed to their fix position by using screw 381 and nut 382.

Furthermore, floor-type rubber block 52 is made of soft rubber and has a cut opening 53 on its top that connects axle hole 55. It can be expanded outwardly to just let its axle holes 55 fit the outer circumference of positioning bushing 50. Afterward, they are screwed to fix position by two fastening holes 56 located on the top plus its associated bolt 57 and nut 58. Under this assembly, floor-type rubber block 52 still can be revolved around positioning bushing 50. After generally and comprehensively viewed the above-mentioned content, we may conclude that there is no any other similar product circulating in the market or no any publication & papers reporting the related content before the application submission of this invention. This invention is having its practical value regarding "newly invented" and "progressive " requirements. It indeed is qualified to the prerequisite required for new patent application. It should be granted the protection of patent law. An application is submitted accordingly.

What is claimed is:

1. A jogging machine having a master frame, and a framework with a jogging board, the framework movably connected to the master frame so as to be movable between a stored position and a use position, the jogging machine comprising:

a) a supporting frame mounted to the master frame and including first and second transverse rods, the first and second transverse rods being spaced apart from one another, and each having opposite ends;

b) a caster assembly mounted on each opposite end of each transverse rod, the caster assembly including a caster having a radius greater than that of the associated transverse rod; and c) at least one block movably mounted on each of the first and second transverse rods, each block having a non-slip surface spaced from the associated transverse rod a distance greater than the radius of the casters on the associated transverse rod, the at least one block being movable between a first position wherein the non-slip surface is in contact with a floor surface supporting the jogging machine thereby elevating the supporting frame such that the casters are out of contact with the floor surface, and a second position wherein the non-slip surface is out of contact with the floor surface such that the casters are in contact with the floor surface to movably support the jogging machine.

2. The jogging machine of claim 1 further comprising two blocks movably attached to each of the first and second transverse rods.

3. The jogging machine of claim 1 wherein the at least one block is made of rubber.

4. The jogging machine of claim 1 further comprising at least one positioning bushing fixedly attached to each transverse rod wherein the at least one block is movably mounted on the at least one positioning bushing.

5. The jogging machine of claim 4 wherein the at least one block comprises:

a) an axle hole configured to slidably engage an outer surface of the at least one bushing;

b) an opening extending through the at least one block in communication with the axle hole; and, c) a pair of fastening protrusions extending from the block, one fastening protrusion located on each side of the opening.

6. The jogging machine of claim 1 wherein each caster assembly comprises:

a) a caster having a first inner through hole;

b) a caster kit having a portion extending into the first inner through hole, the caster kit having a second inner through hole; and, c) a pipe plug extending through the first and second inner through holes and into one of the ends of one of the first and second transverse rods.

7. The jogging machine of claim 1 further comprising a rear floor support rod mounted to the framework so as to support a rear portion of the framework when the framework is in the use position.

* * * * *